US005636629A

United States Patent [19]

Patterson, Jr.

[11] Patent Number: 5,636,629

[45] Date of Patent: Jun. 10, 1997

[54] NASAL GLOVE

[76] Inventor: Willie Patterson, Jr., 1100 Prince SE., Grand Rapids, Mich. 49507

[21] Appl. No.: 557,341

[22] Filed: Nov. 14, 1995

[51] Int. Cl.[6] ..... A62B 18/02

[52] U.S. Cl. ..... 128/207.13; 128/201.18; 128/205.29

[58] Field of Search ..... 128/201.18, 203.21, 128/207.18, 203.22, 204.11, 204.12, 206.11, 206.14, 206.18, 206.25, 207.13, 205.29

[56] References Cited

U.S. PATENT DOCUMENTS

| | | | |
|---|---|---|---|
| 4,004,584 | 1/1977 | Geaney | 128/206.18 |
| 4,214,317 | 7/1980 | Kelly, Sr. | 2/2 |
| 4,240,420 | 12/1980 | Riaboy | 128/206.14 |
| 4,354,489 | 10/1982 | Riaboy | 128/206.14 |
| 4,445,508 | 5/1984 | Lake | 128/201.18 |
| 4,457,756 | 7/1984 | Kern et al. | 604/286 |
| 4,573,461 | 3/1986 | Lake | 128/201.18 |
| 4,955,945 | 9/1990 | Weick | 128/203.12 |
| 4,984,302 | 1/1991 | Lincoln | 2/206 |
| 5,094,236 | 3/1992 | Tayebi | 128/206.12 |
| 5,103,813 | 4/1992 | Hart et al. | 128/201.18 |
| 5,267,557 | 12/1993 | Her-Mou | 128/206.21 |
| 5,357,947 | 10/1994 | Adler | 128/201.13 |
| 5,392,773 | 2/1995 | Bertrand | 128/206.11 |
| 5,419,318 | 5/1995 | Tayebi | 128/205.27 |

FOREIGN PATENT DOCUMENTS

| | | | |
|---|---|---|---|
| 945897 | 12/1948 | France | 128/206.18 |
| 2 658 725 | 8/1991 | France | 128/207.13 |

*Primary Examiner*—Vincent Millin
*Assistant Examiner*—Eric P. Raciti
*Attorney, Agent, or Firm*—Robert J. Sayfie

[57] ABSTRACT

The present invention relates to a nose filter device that is a unitary item which fits snugly on the nose. The nasal glove has essentially two parts, a filter material having a circumference, and enough surface area to cover both nostrils, and the nose of any primate, the second part is a flexible perimeter disposed on said circumference of said filter material which is attached to said circumference by an attaching means, whereby said circumference conforms to the shape of said flexible perimeter, to cover the nose of the user.

9 Claims, 1 Drawing Sheet

NASAL GLOVE

BACKGROUND OF THE INVENTION

1. Field of the Invention

The present invention relates generally to a nose filter device, more particularly, the present invention relates to a nose filter that fits on the outside of the nose, and is comprised of two parts, which are fixed to each other, creating one single unitary filter. The nasal glove is comprised if a material that is porous and permeable to air so the wearer can breath while wearing the filter.

2. Description of Related Art

Consumers often require, or find it beneficial to wear a filter from time to time for reasons such as allergy, or when working with various materials which can create small particles and debris. Consumers can purchase the traditional mask which covers the nose and mouth, and is held on by a rubberband around the head, however this makes talking, eating, and drinking a chore, and also makes one's face extremely hot. The problem with the prior invention nose filters is that they either go up in the nose, like U.S. Pat. No. 4,457,756 by Kern and Westwood, or they may cover the mouth, such as U.S. Pat. No. 5,267,557 by Her-Mou, U.S. Pat. No. 5,419,318 by Tayebi. The filters that go in the nose are primarily used to prevent bleeding, rather than preventing inhalants from entering the nose. Other filters cover more than the nostrils and are too burdensome. U.S. Pat. No. 5,103,813 by Hart and de Weevet completely plugs the nose and makes breathing through the nose impossible.

U.S. Pat. No. 4,445,508 is used to narrow the diameter or close the nostril, thereby increasing the temperature in the nasal passages. This invention does not prevent the concentration of particles being inhaled, unlike the applicant's invention, which screens and filters out the concentration of particles, allergens, and debris.

U.S. Pat. No. 4,573,461 by Lake is a patent to a process. Also, the patent is relating to items which are placed in the nostril. The applicants invention is not placed inside the nostril. If such a filter goes in a nostril, it can damage a sensitive nostril, it gets dirtier easier being in direct contact with the mucous membranes, and is small enough to actually be inhaled, or partially inhaled, thereby creating a health hazard. It can also be exhaled and lost.

Numerous innovations for nasal filters have been provided in the prior art that are adapted to be used. Even though these innovations may be suitable for the specific individual purposes to which they address, they would not be suitable for the purposes of the present invention as heretofore described.

SUMMARY OF THE INVENTION

In according with the present invention, the nasal glove consists of only two attached parts, creating one single filtration device. One element is the filter material, which is circumscribed with a flexible material which can be bent to conform to the shape of noses and nostrils to hold the nasal glove in place notwithstanding the force of gravity and pressure during heavy exhaling. The nasal glove has a filter material and flexible perimeter, which fits on the outside of the nose. The filter material can be attached to a flexible perimeter which can bend for various fits. The filter material is of course porous, and permeable to air, but not small particles.

Broadly considered, the invention comprises a nasal glove capable of being worn by a any being making up the taxonomic order of Primate, including but not limited to *Homo sapiens,* monkeys, and apes, for the filtering of small particles including allergens, dust, and debris. The nasal glove can be worn twenty four (24) hours a day. When the filter gets dirty it can be washed in a clothing washer, a dishwasher, or discarded. The filter material is any material used for filtering particles. This can be, but is not limited to cheesecloth, filter paper, or standard filter cloth.

Accordingly, it is an object of the present invention to provide a breathing filter for the nose.

More particularly, it is an object of the present invention to provide a nasal glove capable of filtering allergens, debris, and dust, from being inhaled by the one wearing the nasal glove. In keeping with these objects, and with others which will become apparent hereinafter, one feature of the present invention resides, briefly stated, in that the nasal glove is capable of being bent to conform to the shape of any primate nose.

When the nasal glove is designed in accordance with the present invention, it can provide the average consumer, and any primate with an economical and affective way to breath cleaner, and not worry about various allergens, dust, and debris. This can be worn by those with allergies, construction workers, or the like.

In accordance with another feature of the invention, the nasal glove allows the wearer to carry this small item in his or her pocket or purse.

Another feature of the present invention is that the item can be manufactured to be disposable, similar to "day wear" contact lenses, and discarded after each wearing. Or, with stronger filter material, the nasal glove can be washed is a regular clothing washer, a dishwasher, or by hand.

Still another feature of the present invention is that the filter material can be of various porosity degrees, depending on the type of filtration desired by the user.

Still another feature of the present invention is that the nasal glove flexible perimeter can be fabricated from a material selected from a group consisting of plastic, plastic composites, fiberglass, plexiglass, stainless steel, copper, metal alloys and rubber composites, thereby staying snugly in place during everyday activities and exercise.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing.

BRIEF LIST OF REFERENCE NUMERALS UTILIZED IN THE DRAWING

100—Nasal glove 100

110—Filter material 110

120—Flexible perimeter 120

130—Attachment means 130

140—Circumference 140

BRIEF DESCRIPTION OF THE PREFERRED EMBODIMENT

DETAILED DESCRIPTION OF THE PREFERRED EMBODIMENT

Figure 1:
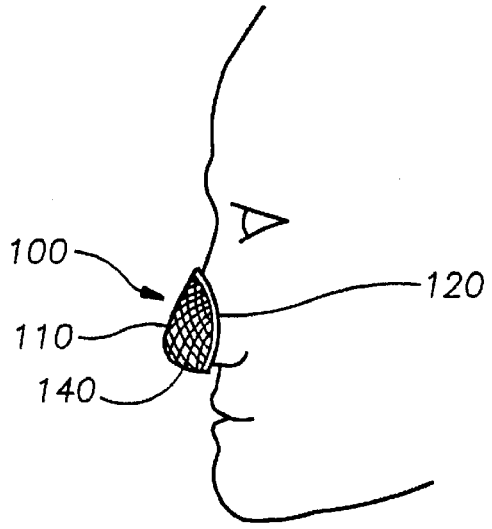
FIG. 1 is a side view of the nasal glove.

Firstly, referring to FIG. 1 which is a side view of the nasal glove 100 shown on the nose of a *Homo sapien*. The flexible perimeter 120 is shown being bent to conform to the shape of the nose and nostrils of the user. This flexible perimeter 120 after being bent, stays in the shape in which it was bent, and can be re-bent and reformed to different shapes of different noses. The flexible perimeter 120 is disposed about the circumference 140 of the filter material 110 to allow the filter material 110 to cover both nostrils when breathing. The filter material 110 is attached to the flexible perimeter 120 by an attachment means 130. The attachment means 130 can be glue, stitching, or any other viable means of attachment 130.

Figure 2:
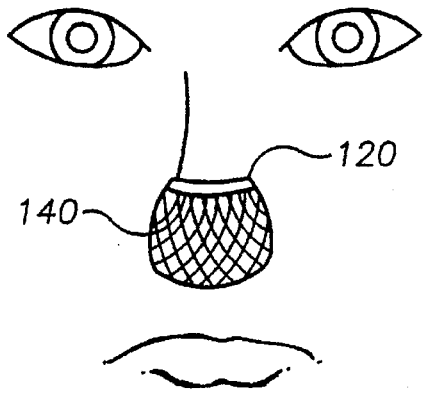
FIG. 2 is a front view of the nasal glove.

Referring to FIG. 2 which is a front view of the nasal glove 100, the flexible perimeter 120 fit around the nostrils can be better exemplified. One can also see how this fits around various widths of noses. The user can force the nasal glove 100 to fit snugly against the nose, or loosely.

Figure 3:
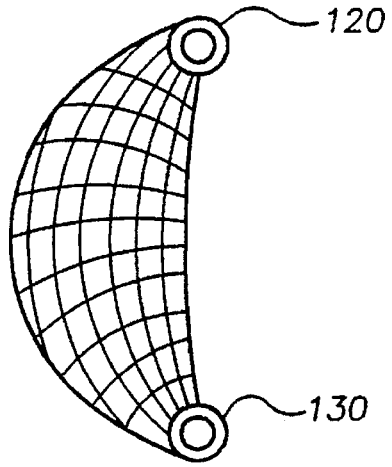
FIG. 3 is a cut away view, showing the flexible perimeter, filter material and attachment means being stitching.

Referring to FIG. 3 which is a cut away view to better show the connection between the filter material 110 and the flexible perimeter 120. The flexible perimeter 120 is shown with the attachment means 130 being stitching, whereby the flexible material 120 is sewn within the filter material 110.

Figure 4:
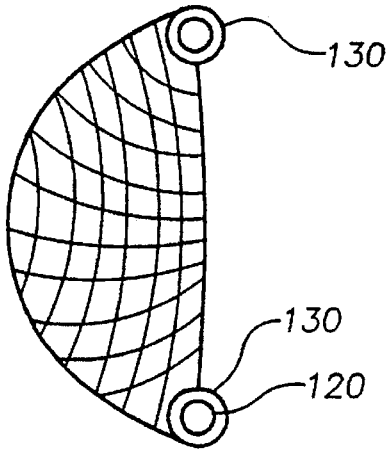
FIG. 4 is a cut away view, showing the flexible perimeter, filter material, and the attachment means being glue.

FIG. 4 which is a cut away view to better show the connection between the filter material 110 and the flexible perimeter 120. The flexible perimeter 120 is shown with the attachment means 130 being glue whereby the flexible material 120 is glued to the filter material 110.

While the invention has been illustrated and described as embodied in a nasal filter, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention. What is claimed as new and desired to be protected by Letters Patent is set forth in the appended claims.

I claim:

1. A nasal glove comprising:

a) a filter material, said filter material having a circumference, said filter material having enough surface area to cover both nostrils of any human; and b) a flexible perimeter disposed on said circumference of said filter material, said flexible perimeter is attached to said circumference by an attaching means, said circumference conformable to the shape of said flexible perimeter, said flexible perimeter being bendable to, and remain in any position contacting and gripping the nose without any adhesive, to cover both nostrils of any human.

2. The nasal glove device of claim 1, wherein the attaching means is glue.

3. The nasal glove device of claim 1, wherein the flexible perimeter is comprised of metallic wire.

4. The nasal glove device of claim 1, wherein the filter material is porous.

5. The nasal glove device of claim 1, wherein the filter material is cheesecloth.

6. The nasal glove device of claim 1, wherein the attachment means is a stitching of said filter material around said flexible perimeter, whereby said flexible perimeter is within said filter material.

7. The nasal glove device of claim 1, wherein the filter material is comprised of open cell foam.

8. The nasal glove device of claim 1, wherein the flexible perimeter is comprised of flexible non-metallic material.

9. The nasal glove device of claim 1, wherein the flexible perimeter is comprised of a material selected from the group consisting of plastic, plastic composites, metal, metal alloy, stainless steel, and rubber composites.

* * * * *